United States Patent [19]

Stephens

[11] Patent Number: 4,828,685

[45] Date of Patent: May 9, 1989

[54] METHOD AND APPARATUS FOR THE ENHANCEMENT OF SUPERCONDUCTIVE MATERIALS

[75] Inventor: Richard B. Stephens, Del Mar, Calif.

[73] Assignee: General Atomics, San Diego, Calif.

[21] Appl. No.: 66,076

[22] Filed: Jun. 24, 1987

[51] Int. Cl.[4] ..... B03B 1/00; B03C 1/00

[52] U.S. Cl. ..... 209/11; 209/2; 209/212; 241/24; 241/79; 505/1; 505/932

[58] Field of Search ..... 209/1-3, 209/11, 212; 241/24, 79; 505/1, 931-933

[56] References Cited

U.S. PATENT DOCUMENTS

| | | | |
|---|---|---|---|
| 731,035 | 6/1903 | Gates | 209/212 |
| 1,829,565 | 10/1931 | Lee | 209/212 |
| 3,217,880 | 11/1965 | Benton | 209/212 X |
| 4,003,830 | 1/1977 | Schloemann | 209/212 X |
| 4,083,774 | 4/1978 | Hunter | 209/212 |
| 4,106,627 | 8/1978 | Watanabe et al. | 209/212 X |
| 4,127,477 | 11/1978 | Schloeman | 209/212 X |
| 4,137,156 | 1/1979 | Morey et al. | 209/212 |
| 4,157,297 | 6/1979 | Alth | 209/212 |
| 4,238,323 | 12/1980 | Zakharova et al. | 209/212 |
| 4,294,690 | 10/1981 | Kollenz | 209/3 |
| 4,330,399 | 5/1982 | Dijkhuis | 209/11 X |

FOREIGN PATENT DOCUMENTS 0017588 10/1980 European Pat. Off. ..... 209/212

*Primary Examiner*—Robert B. Reeves
*Assistant Examiner*—Edward M. Wacyra
*Attorney, Agent, or Firm*—Fitch, Even, Tabin & Flannery

[57] ABSTRACT

A method and apparatus for separating at least one superconductive phase from a multiphase material which may contain multiple superconductive phases and a normal phase by the use of diamagnetic force. A material containing multiple phases is pulverized into granules approximately the grain size of a selected superconductive phase and is then subjected to a force to cause movement of the particles in a particular direction. The selected superconductive phase is made superconducting by cooling the material below its transition temperature. Diamagnetic force is then generated by an applied magnetic field which deflects and separates the superconducting granules but has substantially no effect on the nonsuperconducting granules. Conversely, the selected superconductive phase has a magnetic field applied to it and then is made superconducting to cause a separation. Several specialized apparatus for carrying out the method are disclosed wherein adjustments to a gravitational or other force and the diamagnetic force can be made to provide efficient separation and classification.

37 Claims, 5 Drawing Sheets

METHOD AND APPARATUS FOR THE ENHANCEMENT OF SUPERCONDUCTIVE MATERIALS

The invention relates generally to a method and apparatus for the manufacture of superconductive materials, and is more particularly directed to such method and apparatus which cause the enhancement of the volume percentage of a particular superconductive phase of material in a manufactured multiphase material.

Superconductors are a class of materials whose electrical properties are distinctly different from the familiar triad of conductors, insulators, and semiconductors. They are materials which when in their superconducting state exhibit no resistance to the flow of electric current. The first of such materials was discovered in 1911 by Kamerlingh Onnes. Onnes found that when some metals are cooled to near 0° K (−273° C.), they lose all resistance to the flow of electricity. Since then it has been determined that many, if not most, metals are superconductive if cooled to a low enough temperature.

Modern day physics and medical technologies are the most prevalent users of this phenomenon, including use in magnetic systems in large particle accelerators and nuclear magnetic resonance imagers which have superconductive field coils cooled by liquid helium. These devices generally use niobium alloys which becoxe superconducting at 15° K. Many other uses for superconductive materials are possible, but their commercial application has been restricted by the low temperatures at which the devices must operate. They are used in the scientific and research realm for high speed electronics, radiation and magnetic field detectors, and voltage standards.

It is further believed that superconductors could also find widespread use in the commerce of everyday applications where, in addition to consumer versions of these current applications, they could be used, for example, in lighter more powerful and efficient electric motors and generators, ship propulsion systems, magnetically levitated trains, ore separators, power transmission lines, power storage, and magnetic confinement systems for fusion reactors. Superconductors for high speed electronics promise to provide circuits which are faster by orders of magnitude than those today. The detection of small magnetic fields and small radiation levels (microwave and millimeter wave are thought to be feasible by use of the new SQUID (superconducting quantum interference device) technology.

However, the cost of the cooling mechanisms that must be used to place materials in the superconducting state, and the bulk and expense that insulation for such low temperatures adds to devices has prevented the widespread application of these technologies, and has even limited their use within the scientific and research community, where cost is not an overriding factor in their use. To become widely used in the commerce of every day applications, the cost of manufacturing these materials must be reduced significantly and their cooling mechanisms must be dramatically reduced in size and made less expensive.

Recently, several giant strides have been taken to bring about the commercial use of superconductors. New materials have been discovered that are superconducting at much higher temperatures than have previously been known. Researchers have discovered compounds with superconductivity transition temperatures (Tc) above 90° K, and there are believed to be compounds with even higher transition temperatures (120° K. to more than 240° K.). It is to be expected that materials will be found that have even higher transition temperatures. The new superconductors are typically produced by the solid state reaction of fine powders of their constituent parts. Generally, heat and pressure are used to form these materials, but the compacted material which results from this process often contains several phases of which the superconductive phase may be only a minor component of the total material.

For compounds with Tc approximately 90° K., the superconductive phase resulting from the above reaction may be substantially less than all of the material. Such a material will show zero resistance if the superconductive phase is distributed so that it forms a connected grain structure, but its current carrying capability, and thus its utility, is severely limited by the reduction in the current carrying paths. In the case of a very low volume fraction of the superconductive phase, its grain structure may not form a connected network, and the gross material will not show zero electrical resistance below the transition temperature. This is the current experimental situation with regard to superconductive phases whose Tc is 120° K. or higher. Therefore, to be able to establish confirmation of materials which are superconducting at those temperatures, the volume fraction of superconductive grains of these phases must be increased at least to the point to where there is a connected grain structure.

Moreover, in materials with such a small voluue fraction of superconductor, the identity of the superconductive phase, its composition and structure, and even its presence are hard to establish. In such materials the standard tests for superconductivity may be inconclusive: the conductivity of the material will change only slightly, perhaps immeasurably, and the field excluded at the transition temperature will be very small and difficult to measure. Even if precise measurements were made, it would be difficult to distinguish a particular superconductive phase in the presence of other phases which may have similar structure and differ only by the number of oxygen molecules, for example. Researchers currently proceed with an Edisonian approach for these materials by empirically varying process parameters until the superconductive phase forms a large enough fraction to permit detection and identification.

In such cases it would be extremely desirable to enrich the volume fraction of a selected superconductive phase in a material. In the first instance where a superconducting matrix exists, such an increase could dramatically increase the critical current such superconductor can carry and consequently its utility. In the second instance, with an increase in volume percentage of superconductive grains a superconducting matrix can be established in a material that did not have one from the base process. Finally, the identification of new and more useful superconductive phases could be made if their volume percentage could be enhanced to where they were more easily detectable.

In addition to increasing the volume percentage of a selected superconductive phase in multiphase materials which are made by processes which inherently yield multiple phases, a technique which enhances the volume percentage of a selected superconducting phase can lower the cost of processes which are meant to produce 100% superconductive material by relaxing process control requirements, and compensating for the reduced yield by a rapid and inexpensive refinement process.

The difficulties in producing large volume fractions of the higher Tc superconductors (120° K. and above) suggest that they may not be as thermodynamically stable as the other superconductors, and that there may always be a problem in producing them in industrial quantities at high concentrations. A refinement process would always be necessary in such a case to increase the volume percentage of these phases to a useful amount.

There are many separation processes for dissimilar materials combined in a mixture, but very few are feasible for relatively large volumes. Magnetic separation processes have been used successfully to divide paramagnetic and ferromagnetic materials from nonmagnetic materials and are well suited to industrial type processes where large quantities of materials are separated. The most common separation has been by attracting ferromagnetic materials with a magnet. The problem, however, is that superconductors above their transition temperature are not readily distinguishable or selectable by their magnetic susceptibility. The new high temperature superconductors range from nonmagnetic to moderately paramagnetic in their natural state.

Diamagnetic separation processes have not previously been used to a great extent because many materials in their natural state do not exhibit any strong diamagnetic effect (repulsion of a magnetic field). These separation processes have been limited to separating highly conductive materials, mainly metals, by inducing eddy currents in them and using the diamagnetic force produced as a consequence before the eddy currents dissipate. However, the diamagnetic force on such conductive material is hard to control because of its transitory nature and requires a significant investment in a powerful magnetic field. Since many metals are also ferromagnetic, it is often more facile to use attractive separation processes rather than the repulsive forces of a diamagnetic process.

SUMMARY OF THE INVENTION

The invention provides a method and apparatus for enhancing the volume fraction of a selected superconductive phase of a material which contains one or several superconductive phases and normal phases. The invention uses a diamagnetic separation process to separate, enrich, or classify the selected superconductive phases. Preferably, a material such as a type II superconductor of $YBa_2Cu_3O_7$ containing several phases, at least one of which is superconductive, is refined by this method to produce purer superconductive phases at a much lower cost because the production of this multiphase material is much more convenient and cost effective than the production of pure superconductor in the first instance.

In a preferred embodiment, the method includes providing the multiphase material in a fine granular state. If the process for manufacturing the multiphase material does not result in such form, the process includes physically comminuting the multiphase material by grinding, ball milling, crushing or the like, so that a granular mixture of the phases in small particles results. Optimally, the multiphase material will be pulverized until the granule size approximates the crystallite size of the selected superconductive phase in the material.

According to one aspect of the invention, the mixture is then cooled to below the critical temperature Tc of the selected phase to cause superconductivity in the selected superconductive phase granules. If there exist other undesired superconductive phases in the material, it is preferable to keep the granule temperature above that of the undesired phase, but as much below that of the selected phase as is feasible or practical. This is to allow a maximum magnetic field to be applied without causing the superconductive phase to return to normal conductivity. A magnetic field is then applied such that a diamagnetic repulsion of the field is exhibited by the particles. The magnetic field is applied in a manner that produces a force causing the separation of the selected superconductive phase from the other phases of the material which are not affected.

Alternatively, the material is first immersed in a magnetic field and then cooled to below its superconducting temperature. When the material reaches superconductivity, it excludes the field from the volume of the selected phase and produces a diamagnetic force. The diamagnetic force is directed in a manner causing the separation of the selected superconductive phase from the other phases which are not affected.

The step of separation is advantageously provided by producing motion of the mixture in a first normal direction and then by deflecting the superconductive phase granules in a second deflected direction. The motion in the normal direction can be produced by a number of different types of forces which affect the selected superconductive phase and the other phases of the mixture equally while the diamagnetic force affects the superconductive phase selectively. Examples of useful forces for the separation step are gravitational, modified gravitational or hydraulic forces, or combinations of such.

In one preferred embodix:ent, an apparatus for separating the mixture into superconductive granules and nonsuperconductive granules utilizes the force of gravity along a first inclined plane to cause the granular mixture to move in a normal path in a first direction. The selected superconductive phase is made superconductive by temperature control means prior to motion. A second inclined plane joined to the first, but offset by a deflection angle in a second direction, is used to collect superconductive grains after deflection by diamagnetic force. The diamagnetic force is caused by the application of a predetermined magnetic field and its gradient at the junction of the first and second slides. The field causes the deflection of the superconductive granules from their normal path in the first direction to the deflected path in the second direction because of their diamagnetic repulsion of the superconductive phase granules to the field.

A separation of a particular superconductive phase from other superconducting phases, or from the normal phase, can be accomplished by adjusting the temperature of the mixture. Adjusting the magnetic field in intensity, direction, and gradient; adjusting the gravitational force by the angle of incline; or adjusting the deflection angle can be used to classify superconductive phases or to select grains with a certain volume percent superconductive phase.

In an alternate preferred embodiment, an apparatus utilizes the force of gravity along a first inclined plane to cause the granular mixture to move in a normal path in a first direction. Before becoming superconducting, the superconductive phase and other phase granules are moved into a magnetic field which completely penetrates the mixture. A second inclined plane is joined to the first but offset by a deflection angle in a second direction is used to collect superconductive grains after deflection by diamagnetic force. The diamagnetic force is caused by temperature control means causing the superconductive phase particles to become superconducting in the applied magnetic field and its gradient at the junction of the first and second slides. The expulsion of the field causes the deflection of the superconductive granules from their normal path in the first direction to the deflected path in the second direction because of diamagnetic repulsion of the superconductive phase granules to the field.

Another preferred embodiment is provided by an apparatus forming a magnetic "pipe" for the superconductive phase. In this apparatus, a magnetic field is applied which is practically zero in the center and increases radially therefrom in all directions. Selected superconductive phase particles which are directed at positions displaced radially from the zero field point are urged to congregate or funneled toward the center. The magnetic "pipe" feads superconducting particles along the axis but has substantially no effect on a nonsuperconducting phase. The magnetic pipe is formed of a plurality of alternately opposed poles forming a circular configuration. The poles form a mirror configuration where the field is substantially zero between opposing poles.

A gravitational force may be applied to the mixture such as by dropping it through a vertically oriented magnetic "pipe". The selected superconductive phase is made superconducting by temperature control means prior to the motion. Separation will take place in such embodiment whereby the material in the center of the pipe after the fall will be enriched in the selected superconducting phase. Additionally, the pipe may be inclined such that superconducting material will follow the incline, and the nonsuperconducting phase will be separated by falling vertically.

In still another embodiment, an apparatus moves the mixture granules in a closed hydraulic loop by a carrier fluid. Hydraulic force causes the mixture to move in a normal path in a first direction. Such carrier fluid is controlled by temperature control means to produce superconductivity in at least the superconductive phase. A magnetic field is applied to cause deflection of the superconductive phase granules from their normal path in the first direction to the deflected path in the second direction because of diamagnetic repulsion of the superconductive phase granules to the field. Preferably, for this apparatus the magnetic field is applied by a magnetic "pipe" which is directed to draw the selected superconductive phase particles from the normal path direction to the deflected path direction where they are collected separately from the other phase particles.

These and other objects, aspects, and features of the invention will become clearer upon a reading of the detailed description in conjunction with the appended drawings wherein:

DETAILED DESCRIPTION OF THE PREFERRED EMBODIMENTS

While superconductors do not exhibit remarkable magnetic properties at normal temperatures, they do, at temperatures below the superconducting transition Tc, however, begin to show exotic magnetic properties which the invention uses to advantage. Superconductors when their temperature is lowered below Tc exhibit the Meissner-Ochsenfeld effect, which is the exclusion of a magnetic field from the interior of a superconductor. The effect is somewhat different based on the group of superconductors to which a compound belongs, termed generally type I superconductors and type II superconductors. The new high temperature superconductors have been generally found to be type II superconductors.

Figure 1:
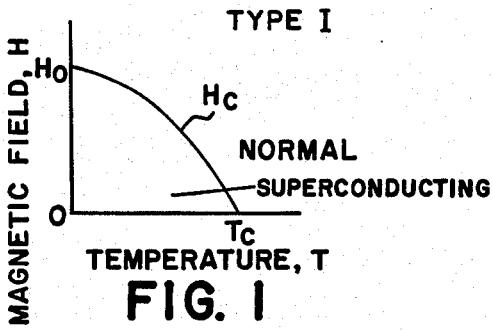
FIG. 1 is a phase diagram illustrating magnetic field H as a function of temperature T for a type I superconductor.

In type I superconductors, any magnetic flux is excluded from the material below a critical field Hc which increases as the temperature decreases below Tc, the superconducting transition temperature. These materials can then be said to be perfectly diamagnetic in this phase. If the applied field is increased above Hc, the entire superconductor reverts to the normal state and the field penetrates completely. A graphical representation of critical magnetic field Hc as a function of temperature T is illustrated in FIG. 1. The graph of field Hc as a function of temperature T shows a phase boundary in the magnetic field-temperature plane separating a region where the superconducting phase is thermodynamically stable from the region where the normal phase is stable. The graph of Hc as a function of T for type I superconductors is essentially parabolic and given, to within a few percent, by:

$Hc = Ho\,[1-(T/Tc)^2]$ where Ho = value of Hc at absolute zero, and is proportional to Tc.

Figure 2:
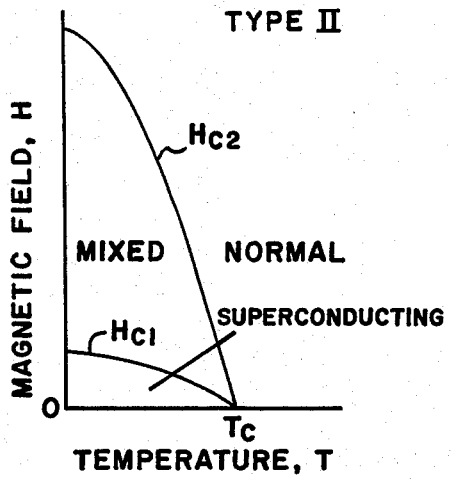
FIG. 2 is a phase diagram illustrating magnetic field H as a function of temperature T for a type II superconductor.

In type II superconductors there are two critical fields, a lower critical field Hc1 and an upper critical field Hc2, as illustrated in FIG. 2. Hc1 is below, and Hc2 is above the thermodynamically determined field Hc by the same factor, k. In applied fields less than Hc1, the type II superconductor completely excludes the field, just as a type I superconductor does below Hc. At fields just above Hc1, however, magnetic flux begins to penetrate the superconductor in microscopic filaments called fluxoids or vortices. Each fluxoid consists of a normal phase core in which the magnetic field is large, surrounded by a superconducting region in which flows a vortex of persistent supercurrent which maintains the field in the core. The total magnetic flux in each fluxoid is exactly equal to a fundamental quantum of magnetic flux, $\Phi = 2.07\times10^{-7}$ gauss$-$cm$^2 = 2.07\times10^{-15}$ Wb. with a diameter typically $10^{-7}$m.

In a sufficiently pure and defect-free type II superconductor, the fluxoids arrange themselves in a regular lattice. This vortex state of the superconductor is known as the mixed state and it exists for applied fields between Hc1 and Hc2. In applied fields above Hc2, the superconductor becomes normal and the field penetrates completely.

Contrasted with the critical field in type I superconductors, which is generally less than 1000 oersteds, Hc2 for type II superconductors may be several hundred thousand oersteds or more. Since a zero-resistance supercurrent can flow in the mixed state in the superconducting regions surrounding the fluxoids, a type II superconductor can carry a lossless current even in the presence of a very large magnetic field. Such superconductors are therefore important in high-field magnets where a type I superconductor would be limited to carrying a supercurrent (critical current) less than that causing a field Hc, lest the magnet induce the normal phase in its superconductor with its own field.

The way in which a superconductor excludes from its interior an applied magnetic field smaller than Hc (type I) or Hc1 (type II) is by establishing a persistent supercurrent on its surface which exactly cancels the applied field inside the superconductor. This surface current flows in a very thin layer of thickness λ, which is called the penetration depth, and depends on the material and on the temperature. The external field also actually penetrates the superconductor within the penetration depth. Generally, an expression for λ as function of temperature is:

$$\lambda = \lambda_o\,[1-(T/Tc)^4]^{-1}$$

where $\lambda_o$ = penetration depth at absolute zero, and is typically of the order $5\times10^{-8}$m.

Figure 3:
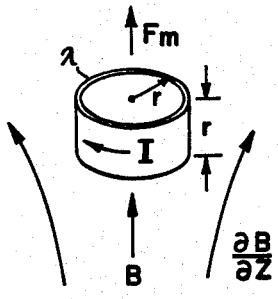
FIG. 3 is a schematic representation of the response of a superconducting granule to an applied magnetic field.

Because of the persistent supercurrents of exclusion, a superconductor has exerted on it a force caused by the interaction of the currents and the applied magnetic field which is diamagnetic in nature. In FIG. 3 there is illustrated a superconducting granule in an applied magnetic field B, which provides a vehicle for examining the diamagnetic force. The granule of the example is a disk of radius r and thickness r immersed in a magnetic field B, which is generally normal to the disk surface but is splayed so that the field has a gradient $\partial B/\partial z$.

Because superconductors exclude magnetic fields, a current, I, is set up in the penetration layer λ to cancel the external field B, the cancelling current being:

$$I = \frac{CrB}{2\pi}$$

where C is the circumference ($2\pi r$) of the disk.

The magnetic force Fm on this current loop directed along the gradient of the field is:

$$F_m = \frac{\pi r^2}{c} I \frac{\partial B}{\partial z} = \frac{r^3}{2} B \frac{\partial B}{\partial z} \qquad (1)$$

The weight of the granule is equal to the force of gravity or mg. The force $mg = \rho\pi^3 g$ where $g = 980$ cm/sec.$^2$, and ρ is the density of the granule. The granules will be levitated when the magnetic force is greater than the weight. For the case of the new superconductors, for which $\rho = 6$g/cm$^3$, the required field strength is:

$$B\frac{\partial B}{\partial z} > 2\pi\rho g = 4\times10^4 \text{ gauss}^2/\text{cm} \qquad (2)$$

where B < Hc1.

Therefore, a method for separating superconductive phase granules such as that illustrated in FIG. 3 from other phases in a mixture comprises making the superconductive phase granules superconducting, levitating them with a magnetic field to cause separation, and then collecting the levitated granules.

As can be seen by equation (1), in general the diamagnetic or repulsive force is proportional to:

$$VB\cdot\nabla B \qquad (3)$$

(a more precise derivation would show that the force is proportional to $V\cdot\nabla B^2$). V, the volume from which flux is excluded, is the entire superconducting volume for fields less than Hc1, and ∇ is the gradient operator for the magnetic field B. The volume V gradually goes to zero between Hc1 and Hc2 in a type II superconductor as more of the field penetrates.

To maximize the magnetic force Fm on a superconductive phase granule of type II superconductor, the magnetic field should be kept just below Hc1 and at a temperature as far below Tc as is convenient. A type II superconductor will continue to partially exclude fields between Hc1 and Hc2 and gains magnetic force because of increases in field between these two points but loses magnetic force because more of the superconductive volume is penetrated by the higher field. The loss of force increases faster than the gain and, thus, a maximum force can be applied just below or substantially at Hc1. It is evident that the maximum magnetic force for a type I superconductor can be provided by a magnetic field just below Hc and at a temperature as far below Tc as is convenient.

While it is shown in equation (2) that a diamagnetic force strong enough to levitate the superconducting particles can be generated by a relatively small magnetic field, it is not even necessary to generate a force this large to cause separation of the superconductive phase granules from a multiphasc mixture. All that is necessary is to use the repulsive diamagnetic force generated on the superconducting particles to generate a deflecting force strong enough to cause separation An efficient method of doing this is to cause the particles to move in a normal first path under the influence of a different force providing the major energy input for overcoming the inertia of the particles and then deflecting them to a different path with the repulsive diamagnetic force.

Figure 4:
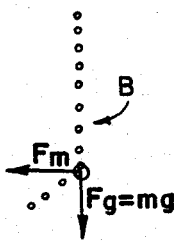
FIG. 4 is a schematic illustration of the deflection of a vertically falling superconducting particle under the influence of gravitational force Fg by a diamagnetic force Fm.

Preferably, the force chosen for providing initial movement in a normal path is the gravitational force. The force of gravity on the superconducting particle is proportional to $\rho$ V', where V', may be larger than V because of flux penetration of a superconductive granule or because the particle contains some nonsuperconductive phase. According to a broad aspect of the invention as illustrated in FIG. 4, a superconducting particle falling through a gravitational field will travel in a normal path in a first direction (vertically) along with other superconductive phases and normal phase particles, all of which will be affected equally by gravity. The application of a controlled magnetic field causes a diamagnetic force Fm to affect the selected superconductive phase by deflecting it from the normal first path thereby separating it. Because normal phase granules and nonselected superconductive phase granules are not affected by the diamagnetic force, they continue to fall in a straight line. Selection of a superconductive phase from other superconductive phases can be provided by controlling temperature to where the selected superconductive phase is superconducting, and the others are not.

The effect of the gravitational force Fg on a superconducting particle may be modified by immersing the particle in a carrier fluid, so that the effective density is $\rho' = \rho - \rho liq$. Thereafter, by moving the carrier fluid under the influence of hydraulic force, the superconducting particles can be deflected from the mainstream direction.

Figure 5:
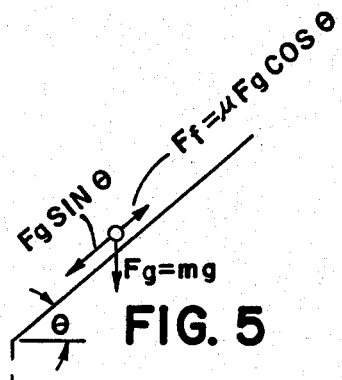
FIG. 5 is a schematic illustration of the effective modification of the gravitational force Fg on a superconducting particle sliding down a plane inclined at an augle $\frac{1}{4}$ to the horizontal.
Figure 6:
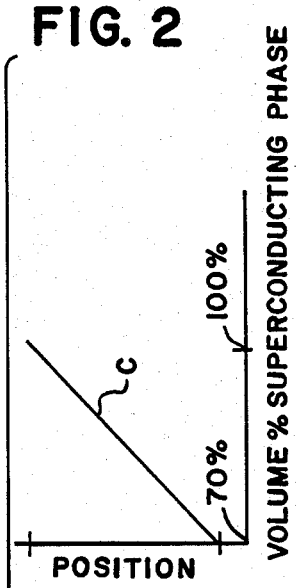
FIG. 6 is a schematic illustration of the deflection of a superconducting particle on an inclined plane subjected to a modified gravitational force Fg and the diamagnetic force Fm.
Figure 6:
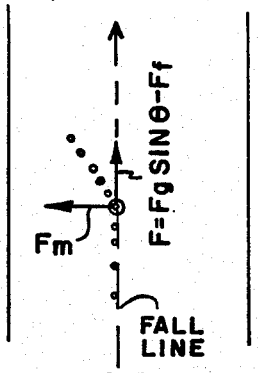

Alternatively, the effect of the gravitational force can be altered by using an inclined plane as shown in FIGS. 5 and 6. FIG. 5 illustrates a side view of the plane and FIG. 6 its top view. The gravitational force Fg pulling particles down the plane is factored by $\sin\phi$, where $\phi$ is the angle which the plane makes with the horizontal. The gravitational force is opposed by the frictional force $Ff = \mu Fg \cos\phi$ where $\mu$ is the coefficient of friction for the plane surface. Ff may be made essentially zero by many techniques such as by vibrating the surface of the plane. A magnetic force $F_m$ can be applied either perpendicularly, as shown in FIG. 6 to the normal direction of travel (fall line) or at some other angle to cause a deflection of the superconductive phase particles while not substantially affecting the nonsuperconductive phase particles. The ratio of the resultant force F to the maximum magnetic force $F_m$ defines the maximum angle $\phi$ to which a selected superconducting particle can be deflected.

Figure 7:
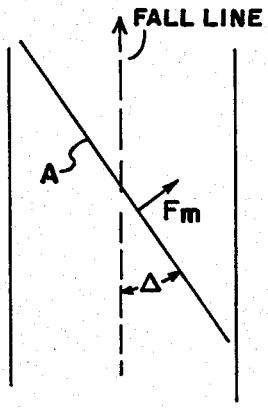
FIG. 7 is a schematic illustration of a magnetic force field inclined at an angle Δ across the fall line of a superconducting particle on an inclined plane.

FIG. 7 which shows a top view of an inclined plane illustrates one method of using this deflection force to reject particles with an insufficient volume percentage of superconductive phase. A magnetic force is applied across the fall line of the granules along a straight line A at an angle $\Delta$ to the fall line. Any granule for which the maximum deflection angle $\phi$ is greater than $\Delta$ will be deflected, and those with insufficient force on them will remain unseparated.

Figure 8:
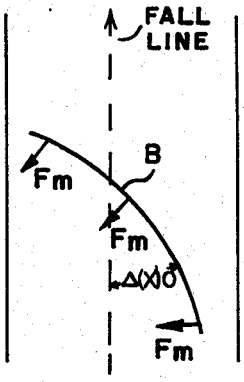
FIG. 8 is a schematic illustration of a magnetic force field inclined at a monotonically increasing angle Δ across the fall line of a superconducting particle on an inclined plane.

As a generalization of the separation method described above FIG. 8 illustrates a top view of a superconducting granule falling on an inclined plane. The magnetic force $F_m$ can be applied in a curved path B crossing the fall line of the particles at an angle $\Delta = \Delta(x)$ to the fall line such that $\Delta(x)$ monotonically increases as the granules proceed down the incline. In such a case the distance over which a granule follows the curved path defined by the force field is dependent upon the volume percentage of its superconductive phase as limited by the maximum angle $\phi$. For granules of the same size, the deflection force will continue to deflect the granules only if they have higher and higher concentrations of superconducting phase as the force will be increasing. Such a method could be used to analyze the distribution of superconductive fractions in the granules. The distribution of volume percentages across the end of the inclined plane can be made to approximate a straight line, as shown by the attached graph C of FIG. 8, by choosing the correct function for the magnetic field. The particles will after their separation show the smallest volume percent on the right hand side of the inclined plane (as seen in FIG. 8) and the largest volume percent on the left hand side of the plane. after separation by such a method, those low volume percentage superconductive phase granules can be either reprocessed or combined with other granules to increase the total volume percentage of a selected superconductive phase therein.

There are in fact two related exotic magnetic properties in superconductors which the invention uses to advantage. There is the classic Meissner-Ochsenfeld effect discussed above where, if a superconductor in its normal state is disposed in a magnetic field, lowering the temperature of the material below the transition temperature Tc where it becomes superconducting will cause an exclusion or expulsion of the field from the material. Conversely, if a material is already in its superconducting state, i.e., it is cold enough to become ordered, placing the material in a magnetic field will cause it to prevent penetration of the field. In either case, a diamagnetic force is set up because of the persistent supercurrents in the penetration layer $\lambda$, which in the first case expels the field and in the second does not permit the field to penetrate.

Figure 12:
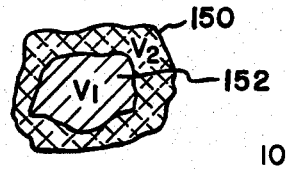
FIG. 12, is an enlarged cross-sectional view of a mixture granule having a normal phase center surrounded by an outside shell of a superconductive phase.

As to the magnitude of the force, the forces are equivalent in both cases if the superconductor is 100% pure. Such, however, is not the case if the material contains multiple phases, and particularly not if the selected superconductive phase forms a shell surrounding a nonsuperconducting or normal phase. Such a case is shown in FIG. 12 where a multiphase grain has an outer shell of superconductive phase of volume V2 surrounding a core of normal phase material of volume V1. This physical combination is very likely to take place when a number of normal material grains, such as the oxides of the constituent materials of a superconductor, are packed and then sintered together. The diffusion of the materials may be incomplete because a high enough temperature was not reached, too short an interval was used, or oxygenation was insufficient. Further, the grain structure for a number of reasons may have been larger than the process could tolerate. In any event, the incomplete conversion of the grain into superconductor has left an outer shell of superconductive phase material surrounding a normal phase core.

From equation (3) it will be remembered that the repulsive diamagnetic force is proportional to the volume from which the flux of the magnetic field is excluded, in one case, or the volume which the flux of the magnetic field does not penetrate, in the other. If the grain is in an applied magnetic field and becomes superconducting then, as one might expect, the field is excluded from volume $V_2$ of the shell. However, a more surprising result occurs when the grain is first made superconducting by cooling it below temperature Tc and then a magnetic field is applied. The outer shell $V_2$ of the superconductor prevents the field from penetrating the entire volume including the normal phase core thereby shielding it. This has the effect of increasing the diamagnetic force proportionally to the superconductive volume and shielded volume, in this example $V=V_1+V_2$. It is believed that when a superconductive phase is combined with a normal phase in any physical manner there may be some degree of this shielding and consequent increase in the diamagnetic force. What is proposed in the Figure is a probable mechanism for explaining that effect in the most optimal circumstances. Multiplications of the diamagnetic force in multiphase materials of up to approximately 4–6 times the force seen for a true Meissner-Ochsenfeld effect have been noted. Such increase in the diamagnetic force can be used to advantage in varying the separation process.

Figure 9:
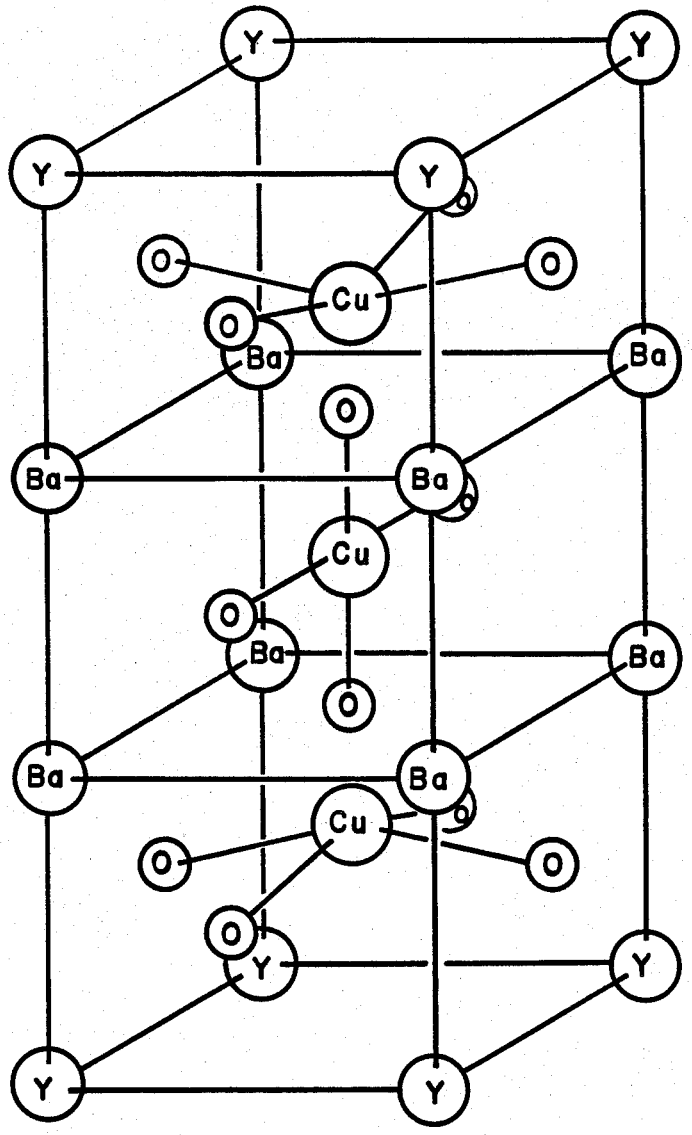
FIG. 9 is a pictorial representation of a unit cell of a new superconductor material which is typically formed in a multiphase matrix, and whose concentration of a selected superconductive phase can be enriched by the method and apparatus of the invention.

FIG. 9 illustrates a unit cell of one of the recently discovered 90° K superconductors, $YBa_2Cu_3O_7$, which can be manufactured by a number of techniques. The structure can be produced by reacting the stoichiometric amounts of Y, Ba, and Cu (as metals, oxides, nitrates, citrates, etc.) at high temperatures to allow the molecules to combine by diffusion and form an oxygen deficient version of the structure in FIG. 9. The resulting material is then cooled sufficiently slowly in oxygen so that the structure takes up enough oxygen to permit the formation of orthorhombic chains and to control their order. The method described above normally produces some multiphase material.

Another method of making the superconductor compound described above is more fully disclosed in a U.S. patent application No. 42,465, filed Apr. 24, 1987 and which is commonly assigned with the present application. The disclosure of U.S. application Ser. No. 42,465 is hereby expressly incorporated by reference herein.

The results may also be reached by a variety of other different and diverse chemical routes. Very fine grained dispersions from solutions, or vapor deposition of thin films enable the interdiffusion, compound formation, and oxygenation to be carried out with faster kinetics but require precise control. Proper control, which must be optimized for each process, may be able to yield 100% by volume superconductive material in many processes but such control may take too long or be too difficult and expensive to make these materials in bulk and with an uncomplicated manufacturing process. Moreover, because of the temperature instabilities of the higher temperature superconductors, those above 120° K, these processes may never be able to make a 100% volume superconducting phase. Therefore, there exists the necessity for refining the materials made by these processes, if they contain less than 100% of the selected superconductive phase desired, to enrich them to as great a percentage of the selected superconductive phase as possible and to remove other superconductive phases or normal phases.

One process which is believed to have industrial commercial applications consists of mixing powders or granules of $Y_2O_3$, BaO, and CuO such that the proportions of Y:Ba:Cu are 1:2:3, respectively. The mixture is then tumbled for a time to ensure homogeneity. The powder is thereafter cold pressed into pellets or cakes under pressure and heated to a temperature at which the constituents can diffuse into one another. The mixture is then cooled in an oxygenated atmosphere to form a multiphase mixture with an unknown volume precent of a superconductive phase, or multiple superconductive phases, and a normal phase.

The mixture is then comminuted by conventional means (grinding, crushing, etc.) into fine granules which can be graded by the percent volume of superconductive phase which they contain by the method hereinafter described. If they contain insufficient superconductive phase, the particles can be further reduced in size until the particles containing the superconductive phase are approximately 100% superconductor. It may be desirable after comminution to thermally anneal the granules for a short time. This will assist in reversing any structural damage caused by the comminution, such as dislocations from the grains, and will enhance their superconductive properties. Whether or not a group of particles need to be annealed depends on the material used in the first instance. Optimally, the comminution is to reduce particle size to just the superconductive grain or filament size in the mixture because otherwise the superconducting coherence length will be reduced. Thereafter, the superconductive phase particles are separated from the normal phase or other superconductive phases by the method and apparatus hereinafter described.

The fines or waste material from the separation process which contains the normal phase or nonselected superconductive phases is already ground up in a form which can be conveniently reprocessed with more raw material. The enriched superconductive phase which was separated, is in a fine granular form which can be used as the raw material for further processes such as the, manufacture of magnet wire, transmission bars, or active logic wafers.

Figure 10:
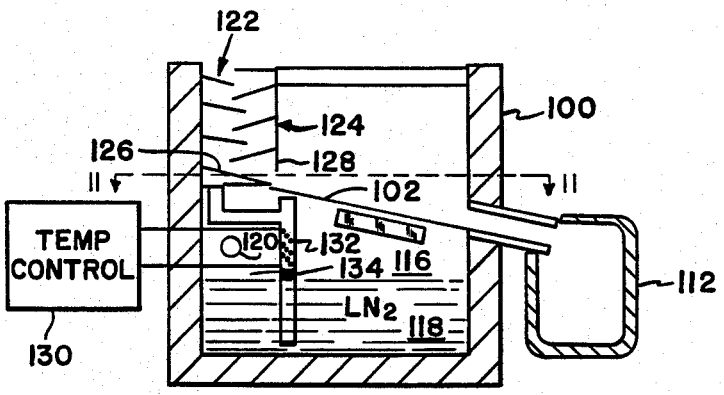
FIG. 10 is a vertical sectional view of a separation apparatus constructed in accordance with the invention take along line 10—10 of FIG. 11.
Figure 11:
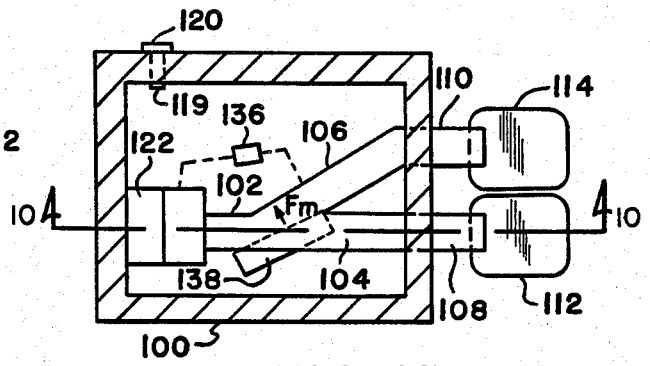
FIG. 11 is a horizontal sectional view of the separation apparatus illustrated in FIG. 10 taken along line 11—11 of FIG. 10.

A preferred implementation of a separation apparatus using diamagnetic force to select a particular superconductive phase in a multiphase material is shown in FIGS. 10 and 11. An insulated container 100 surrounds an inclined separation slide 102 having a bifurcated path. One of the legs 104 of the path is directed in a first direction and used to collect the nonselected superconductive and nonsuperconductive phases of the comminuted material moving in a normal path, and the other leg 106 is directed in a second direction and used to collect a particular superconductive phase or those phases which are superconductive above a certain temperature moving in a selected path. The legs 104 and 106 exit the container 100 through covered insulated ports 108 and 110, respectively, such that material moving along the legs will be collected in closed receptacles 112 and 114, respectively. The slide leg 106 is positioned at an adjustable deflection angle with respect to the slide leg 104 such that only selected volume percent phases can be obtained.

The slide 102 is elevated within the container 100 to provide a reservoir space 116 for a cooling liquid 118, such as liquid nitrogen ($LN_2$), some other fluid or the cold stage of a mechanical refrigerator, or the like. Preferably, because of its low cost and the particular superconductive phase to be separated, the embodiment will use $LN_2$, but other coolants will work equally as well provided their temperature achieves superconductivity for the selected phase. The cooling means selected should be matched with the Tc of the superconductive phase desired to be separated. The cooling liquid can be replenished through a filling hole 119 which is stopped with plug 120. The $LN_2$ evaporates, drawing heat from its surroundings, including the slide 102 and the multiphase mixture on the slide, to cool the mixture below the superconducting temperature Tc.

The multiphase mixture or powder is poured into the separator apparatus via a slot 122 in the top of the container. A series of opposing inclined plates form an entrance baffle 124. The last plate 126 in the baffle 124 is adjustable as to its inclination relative to an opening in a wall 128 and provides an adjustable orifice between the baffle 124 and the slide 102 to control the rate of particles entering the slide area. Because the system is substantially closed, the $LN_2$ vapor can escape only through the entrance baffle 124, thereby cooling the mixture and preventing moisture or heat from entering the apparatus. If a mechanical refrigerator is used as a cooling means, dry gas will be flowed through the apparatus to keep it purged of condensible vapors for operation below room temperature.

A temperature control 130 regulates a resistive heater 132 to control the temperature of the entrance baffle 124 and the slide 102 to a few degrees above the $LN_2$ temperature. This allows flexibility to separate superconductors whose Tc is somewhat above the $LN_2$ temperature even when they are mixed with phases with lower Tc. For example, one can separate a superconductive phase whose Tc is above 90° K in the presence of a 90° K superconductor phase by raising the temperature of the apparatus to above 90° K. As indicated previously, the magnetic force Fm can be maximized by lowering the temperature below Tc as far as is convenient. The separation of multiple superconductive phases can then be accomplished by controlling the temperature to below Tc for the highest temperature phase but just above Tc for the next phase, and then separating that phase. The rest of the superconductive phases can then be separated in sequence. An insulator 134 is provided between the $LN_2$ and the remaining support structure to minimize any heat path to the $LN_2$. This helps minimize the power requirements for the temperature control and $LN_2$ loss while permitting the configuration to handle the heat load from the incoming particles.

It is important that the particles of the mixture do not stick or clump together, and the mixture should be relatively dry (without moisture) before its introduction into the apparatus. The temperature control 130 by maintaining the slide a few degrees above the $LN_2$ temperature also prevents a film of solid $N_2$ on the slide which would prevent the particles from moving. In connection with this aspect of the invention, a vibration means 136, either in the form of a piezoelectric crystal, a buzzer coil or a motor rotating an eccentrically mounted load, is mechanically connected to both the baffle 124 and the slide 102. The vibrations caused by the vibration means 136 create a slight agitation of the granules such that they maintain mobility and are thus mainly influenced by the gravitational and diamagnetic forces applied. Such agitation, for example, substantially reduces any frictional forces tending to restrain the particles during their fall.

Figure 13:
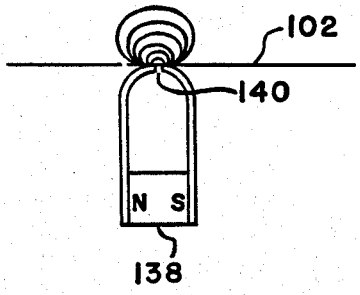
FIG. 13 is an-end view of the deflecting magnet illustrated in FIGS. 10 and 11 showing its flux pattern and polarity.
Figure 14:
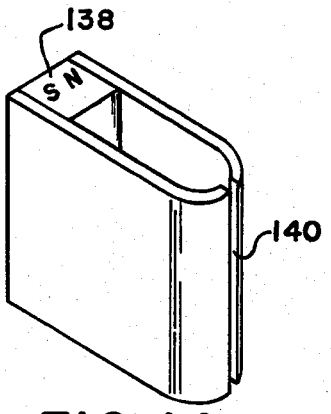
FIG. 14 is an isometric view of the deflecting magnet illustrated in FIG. 13.

The magnetic field $B \cdot \nabla B$ is applied to the superconducting particles by means of a magnet 138. The magnet can be either a permanent magnet, such as of samarium cobalt, or an electromagnet, possibly superconducting. What is required is that the maximum B field that the particles encounter be slightly less than Hc1 for the maximum separation force. A preferred form for the magnet 138 is illustrated in FIGS. 13 and 14 where the poles are located at a sharp edge 140 such that the field has a strong gradient along the edge. The direction of the magnetic force Fm will be generally radially outward from the edge 140 such as that shown in FIG. 11.

In operation, the multiphase mixture containing at least one superconductive phase is poured in or transferred to the slot 122. The mixture under the influence of the vibrations of vibration means 136 and gravity travels at a controlled rate, because of the orifice in the wall 128, through the baffle 124 and down the slide 102. The selected superconductive phase granules will slide some distance over the magnet 138 and be influenced by a diamagnetic force which deflects them to the track or leg 106. Those granules which are not superconducting, and those granules with not enough volume fraction of superconductor to be deflected the total deflection angle $\Delta$ between legs 104 and 106, continue in the normal path down the slide on the leg 104 in a generally straight line to be collected in the receptacle 112. The separated superconductive phase granules on leg 106 continue their descent into the receptacle 114.

Figure 15:
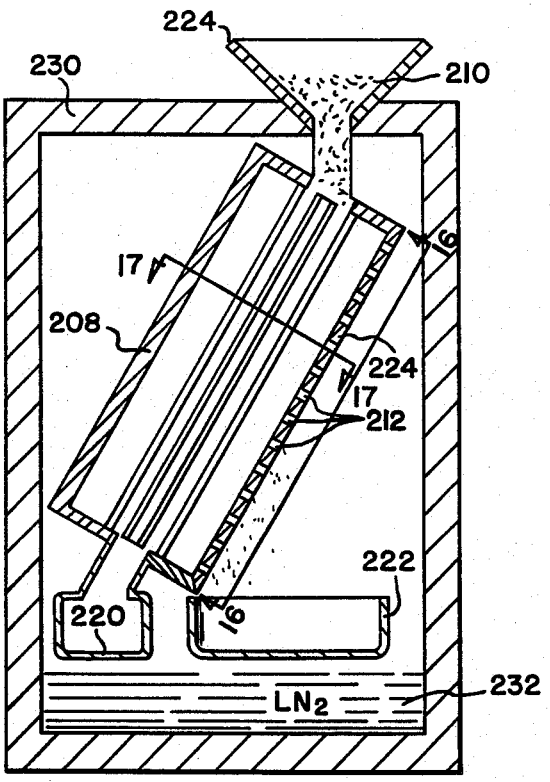
FIG. 15 is a vertical section view of another embodiment of a separation apparatus constructed in accordance with the invention.
Figure 16:
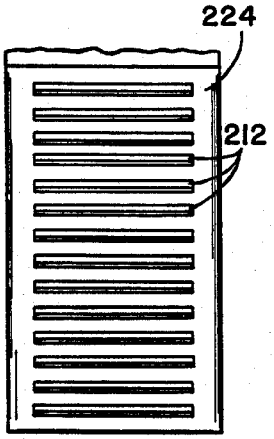
FIG. 16 is a view of a portion of the apparatus shown in FIG. 15 taken along line 16—16 of FIG. 15.
Figure 17:
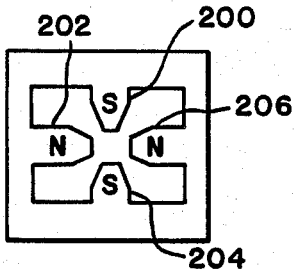
FIG. 17 is a cross-sectional end view of the magnetic structure taken along line 17—17 of FIG. 15.
Figure 18:
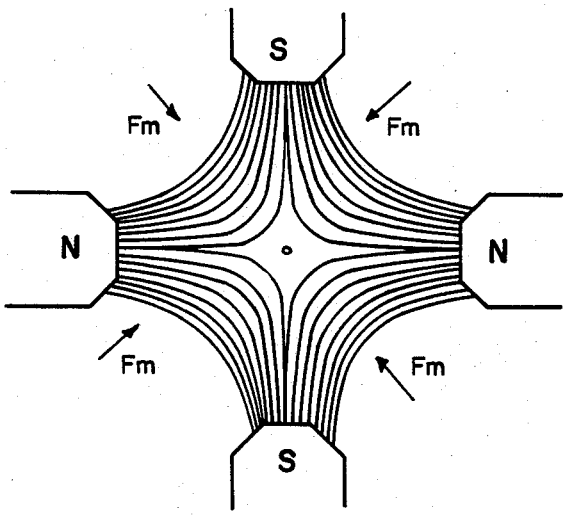
FIG. 18 is a pictorial diagram of the flux pattern of the magnetic structure illustrated in FIG. 17.

FIGS. 15–18 show a second embodiment of the invention wherein a magnetic "pipe" is used to separate the superconductive phase granules from other phases in the mixture. The magnetic "pipe" is formed by four or more pole pieces 200, 202, 204, and 206 (FIG. 17) of alternating polarity and the flux pattern produced by these mirror poles is shown in FIG. 18. The field B is stronger closer to the poles and weaker toward the center, where theoretically there is a field of zero. In this embodiment, the gradient of the field $\nabla B$ is radially directed toward the center. This mirror geometry can be formed by two or more opposing poles. The configuration is elongated along a central axis to form a magnetic "pipe" as shown in FIG. 15. With this configuration, superconducting granules will always be subject to a radial force directed toward the center. Such force will be smaller closer to the center and larger farther away from the center. For an elongated magnetic structure, such as in FIG. 15, superconducting particles introduced between the pole pieces become centered in the substantially flux-free center of the "pipe38 structure 208.

If the structure is used vertically, such as by dropping multiphase mixture straight through the device, it will be seen that centered in the deposited mixture being refined is a higher concentration of superconductive particles. The separation process can be enhanced by tilting the apparatus at an angle as illustrated in FIG. 15 such that the force of gravity assists with the discrimination between the superconductive phase and nonsuperconductive phases. When tilted, the gravitational field acts through the angle on the superconductive phase and vertically on the other particles to cause separation. A container 220 is used to collect the superconductive phase granules, and a container 222 is used to collect nonsuperconductive phases that fall through sieve apertures 212 (FIG. 16) in the wall 224 of the apparatus. The apparatus is surrounded by an insulated container 230 having a reservoir of liquid coolant 232 such as $LN_2$.

In operation, a funnel means 210 is loaded with the multiphase mixture and cooled to the desired temperature for the selected superconductive phase by a $LN_2$ blanket 224. The funnel end concentrates the material into the center of the magnetic "pipe". That material which either does not contain a high enough volume fraction of selected superconductive phase, or is nonsuperconducting, will fall out (straight down) of the magnetic "pipe" because no diamagnetic force deflects these particles. Such nonaffected particles pass through the sieve apertures 212 and are collected in the trough 222.

In either of the foregoing embodiments the multiphase material mixture may be mixed with a carrier fluid to reduce its apparent density by the buoyancy of the liquid. The liquid, if it is liquid $N_2$, may be used to keep the material below its critical temperature Tc. Further, combining the mixture with a liquid slows the travel of the particles down an inclined plane or magnetic "pipe", allowing the application of diamagnetic force over a greater period of time.

Figure 19:
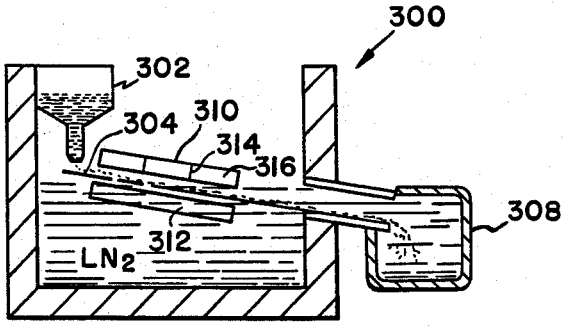
FIG. 19 is a partly diagrammatic side view of a further embodiment of a separation apparatus constructed in accordance with the invention.
Figure 21:
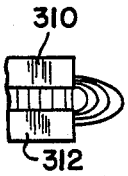
FIG. 21 is a partially fragmented end view of the magnetic structure illustrated in FIG. 20.
Figure 20:
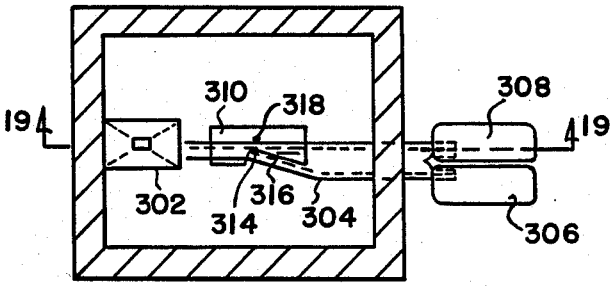
FIG. 20 is a partly diagrammatic top view of the apparatus illustrated in FIG. 19.

Another embodiment of an apparatus useful in separating a selected superconductive phase from a multiphase material will now be more fully described in conjunction with FIGS. 19 to 21. An apparatus 300 has many aspects in common with the separation apparatus of FIGS. 10 and 11 in that comminuted material 302 having multiple phases, at least one of which is superconductive, is placed on a slide 304, where under the influence of gravity, the material moves in a first normal path through an applied magnetic field and is thereafter divided into superconductive and nonsuperconductive phases. The separation process uses diamagnetic force to deflect the superconductive phase granules from a normal path on the slide 304 to a deflected path where they can be collected separately from the normal phase or other superconductive phases in a receptacle 306. The normal phase granules and other superconductive phase granules will be collected at the end of the normal path in receptacle 308.

The embodiment, however, differs significantly from the embodiment of FIGS. 10 and 11 because the diamagnetic force developed is due to the Meissner-Ochsenfeld effect, i.e., the selected superconductive phase particles are placed in a magnetic field before cooling them to their superconducting temperature. This has the effect of excluding the field only from the superconductive phase volume and there is no shielding effect.

The embodiment operates by having a relatively uniform magnetic field B applied to the multiphase particles on the slide 304 by a magnet having elongated pole faces 310, 312. The magnetic field is substantially perpendicular to the face of the slide 304 and does not at the outset affect the particles, either superconductive or normal phases, because they are above the transition temperature Tc. The field does penetrate all of the particles in their entirety.

The selected superconductive phase particles are then made superconducting by passing them through a bath of $LN_2$ in which one end of the slide 304 is emersed. This configuration provides a temperature gradient along the slide 304 where the temperature above the bath of $LN_2$ is above the transition temperature Tc and that below the surface of the bath is below the transition temperature Tc. Therefore, particles which were previously penetrated fully by the magnetic field on the portion of the slide 304 above the bath now exclude the field when they fall beneath the surface of the bath and become superconducting. The exclusion of the magnetic field causes diamagnetic force which is used in a separation process.

As shown in FIG. 20 at least the top pole face 310 is notched with an indent 314 which occurs at substantially the location on the slide 304 where the selected superconductive phase particles become superconducting. The indent edge 316 makes an angle $\Delta$ with respect to the normal path on the slide. The edge 316 produces a fringing field across the gap between poles 310, 312 as shown in FIG. 21.

This fringing field B produces a gradient $\nabla$ B which in combination with the magnetic field strength exerts diamagnetic separation force on the particles in a direction substantially perpendicular to the edge 316. This force therefore produces the same type of separation as that described for FIGS. 10 and 11 except for the volume of the material effected. Because the magnetic field B was applied prior to making the mixture superconducting, there is no shielding effect and the only volume influenced by the diamagnetic force is that of the selected superconductive phase. The diamagnetic force may be significantly less than in the embodiment illustrated in FIGS. 10 and 11 but can be made substantial enough to be useful because of the high gradient of the fringing field. The pole faces 310 and 312 are mounted on a pivot 318 so that the angle can be easily adjusted.

This embodiment is particularly useful in classifying or grading the % volume of a selected superconductor phase in an ore or mixture of multiple phases. If the ore is comminuted coarsely at first, all the grains will contain approximate the same percent of superconductor and will be deflected at substantially the same angle. This is an indication, if an optimal or complete separation is desired, that the material is not fine enough yet and should be pulverized further. When the size of the average grain approaches the crystallite size of the superconductor phase, the grains will contain varying % distributions of superconductor and will be deflected at a number of angles. As the grain size of the mixture is reduced further, the size will approximate the crystallite size of the superconductor and the grains will be either substantially superconductive phase or not. When the grain size reaches this point, a distinct separation into two distinct paths can be made by the diamagnetic force.

Thus, a method for classification and determining the superconductor grain size can be provided by this embodiment. Such classification is not masked by screening effects and provides a significant analytical tool with which to study these materials. Further, it may be used alone or in combination with the embodiment of FIGS. 10 and 11 as a separator. Moreover, as taught previously, the intensity, gradient, and application direction of the magnetic field may be varied to adjust the process parameters. Further, the coolant can be other than $LN_2$ and chosen for the selected superconductive phase. Mechanical temperature control means can vary the temperature profile on the slide to controllably select the particular superconductive phase.

Figure 23:
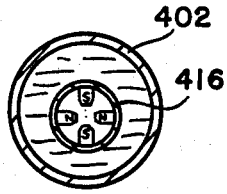
FIG. 23 is a sectional end view of the separation apparatus illustrated in FIG. 22 taken along line 23—23 of FIG. 22.
Figure 22:
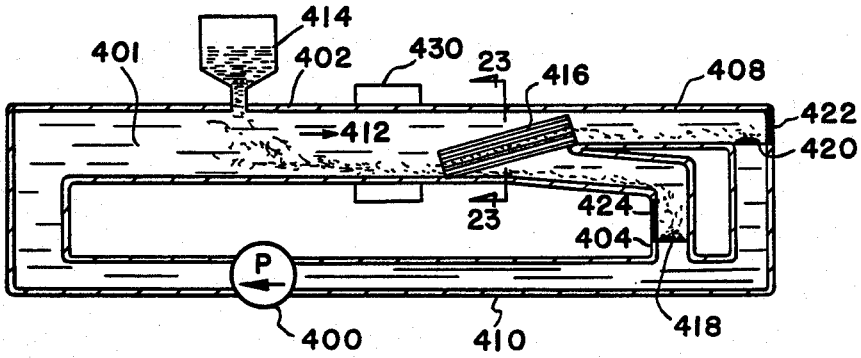
FIG. 22 is a schematic side view of a further embodiment of a separation apparatus constructed in accordance with the invention.

FIGS. 22 and 23 illustrate another embodiment of the invention which uses hydraulic force in addition to a gravitational force to move mixture particles in a first normal direction. The embodiment then uses a magnetic "pipe" to deflect a superconductive phase into a second selected path to separate it from the other constituents of the mixture.

A closed hydraulic system is provided in which a pump 400 provides a head pressure on a fluid 401 moving in closed circuit. The fluid 401 under the influence of the pressure developed by the pump 400 flows in the direction indicated by an arrow 412 through an entry conduit 402, splits into two collection conduits 404, 408, and is fed back to the input of the pump through a return conduit 410. The fluid 401 is constantly in motion and recirculates to produce a hydraulic force which causes particles immersed in the fluid to move in a first normal direction, arrow 412. A hopper 414 is loaded with fine granular multiphase material having at least one superconducting phase. The material is fed into the entry conduit 402 at its distal end at a controlled rate. Gravity will cause the particles to migrate toward the bottom of the conduit 402, and hydraulic force will move them in the direction of arrow 412.

Preferably, the fluid 401 is a coolant, such as $LN_2$, so that the superconductive phase rapidly becomes superconducting. When the particles reach a particular point in the normal path of conduit 402, they are subjected to the applied diamagnetic force of an inclined magnetic "pipe" 416. The magnetic pipe 416 causes the superconducting particles to be deflected from the normal path by drawing them up the pipe to the collection conduit 408, while the normal phase particles proceed to the collecting conduit 404. Filters 418, 420 in conduits 404, 408, respectively allow the separated particles to be recovered through traps 422, 424, respectively.

If the fluid 401 is not a coolant at the temperature needed for superconductivity of the selected superconductive phase, then mechanical temperature control means, such as that shown diagramatically as 430, can be used to provide the necessary temperature. Such temperature control means 430 are also useful for producing different temperatures needed for separating multiple superconductive phases. It is further evident that the apparatus illustrated in drawing FIGS. 22 and 23 can be placed in different orientations so that the effect of gravity on the particles is applied most advantageously.

While the preferred embodiments of the invention have been described in the detailed description, it will be obvious to one skilled in the art that various modifications can be made thereto without changing the spirit and scope of the invention. For example, while the two embodiments describe the separation process with respect to gravitational, or modified gravitational force, and diamagnetic force, any other force in combination with the diamagnetic force can be used. The mixture particles can be moved in a particular direction on a belt and deflected from that path, or deflected from a carrier stream flowing in a particular direction.

What is claimed is:

1. A method of enhancing the volume percentage of a selected superconductive phase in a multiphase material having at least one superconductive phase, said method comprising the steps of:

providing the multiphase material as a mixture of fine granules;

maintaining the granules at a temperature where at least the selected superconductive phase exhibits superconductivity;

applying a magnetic field to the mixture to exert diamagnetic force selectively upon the granules containing the selected superconductive phase; and separating from the mixture at least a portion of said granules containing the selected superconductive phase on which said diamagnetic force was exerted.

2. A method as set forth in claim 1 wherein the step of providing the material includes:

identifying the size of grains of said selected superconductive phase in said material; and comminuting the material until the granule size of the mixture approximates the identified grain size of the grains of selected superconductive phase.

3. A method as set forth in claim 1 wherein said selected superconductive phase is the superconductive phase of said multiphase material having any substantial volume percentage with the highest superconducting temperature and wherein said step of maintaining the temperature includes:

cooling said mixture to a temperature below the transition temperature of said selected superconducting phase but a temperature above the transition temperature of any other superconducting phase having any substantial volume percentage.

4. A method as set forth in claim 1 wherein:

the intensity of the applied magnetic field is just below the penetration intensity Hc1 of the selected superconducting phase.

5. A method as set forth in claim 1 including:

moving tha mixture under the influence of gravity;

deflecting at least a portion of said superconductive phase granules from said gravitational movement with said diamagnetic force; and collecting said deflected portion.

6. A method as set forth in claim 1 including:

suspending said mixture in a carrier fluid;

deflecting at least a portion of said superconductive phase granules from their suspended locations in said carrier fluid with said diamagnetic force; and collecting said deflected portion.

7. A method as set forth in claim 1 including:

suspending said mixture in a carrier fluid;

moving said carrier fluid by hydraulic force;

deflecting at least a portion of said superconductive phase granules from said hydraulic movement with said diamagnetic force; and collecting said deflected portion.

8. A method of enhancing the volume percentage of a selected superconductive phase in a multiphase material having at least one superconductive phase, said method comprising the steps of:

providing the mutiphase material as a mixture of fine granules;

applying a magnetic field to the mixture at a temperature above the transition temperature of said selected superconductive phase such that the field completely penetrates the phases of the material including said selected superconductive phase;

changing the temperature of the mixture to a temperature where at least the selected superconductive phase exhibits superconductivity to exert a diamagnetic force selectively upon the granules containing the selected superconductive phase; and separating from the mixture at least a portion of said granules containing the selected superconductive phase on which said diamagnetic force was exerted.

9. A method as set forth in claim 8 wherein the step of providing the material includes:

identifying the size of grains of said selected superconductive phases in said material; and comminuting the material until the granule size of the mixture approximates the identified grain size of the grains of selected superconductive phase.

10. A method as set forth in claim 8 wherein said selected superconductive phase is the superconductive phase of said multiphase material having any substantial volume percentage with the highest superconducting temperature and wherein said temperature changing step includes:

cooling said mixture to a temperature below the transition temperature of said selected superconductive phase but a temperature above the transition temperature of any other superconductive phase having any substantial volume percentage.

11. A method as set forth in claim 8 wherein:

the intensity of the applied magnetic field is just below the penetration intensity Hc1 of the selected superconductive phase.

12. A method as set forth in claim 8 including:

moving the mixture by gravity;

deflecting at least a portion of said superconductive phase granules from said gravitational movement with said diamagnetic force; and collecting said deflected portion.

13. A method as set forth in claim 8 including:

suspending said mixture in a carrier fluid:

deflecting at least a portion of said superconductive phase granules from their suspended locations in said carrier fluid with said diamagnetic force; and collecting said deflected portion.

14. A method as set forth in claim 8 including:

suspending said mixture in a carrier fluid;

moving said carrier fluid by hydraulic force;

deflecting at least a portion of said superconductive phase granules from said hydraulic movement with said diamagnetic force; and collecting said deflected portion

15. Apparatus for separating a selected superconductive phase from a granular multiphase material wherein granules contain different volume percentages of said selected superconductive phase, said apparatus comprising:

a nonmagnetic inclinded slide for applying a resultant gravitational force to material thereon causing said material to move by gravity in a first normal direction in a first normal path, wherein the amplitude of the resultant gavitational force is determined by the inclination of said slide;

means for controlling the temperature of said material on the slide to where at least said superconductive phase granules are superconducting;

magnet means for applying a magnetic field to said material on the slide such that at least a portion of any said selected superconductive phase granules on the slide are deflected from said first normal path to a second selected path by diamagnetic force; and means for collecting said deflected superconducting phase granules.

16. Apparatus as set forth in claim 15 which further includes:

means for adjusting the inclination of said slide.

17. Apparatus as set forth in claim 16 which further includes:

means for adjusting the magnitude of the deflection from said first normal path.

18. Apparatus as set forth in claim 15 wherein said magnet means includes:

means for adjusting the intensity and direction of said magnetic field.

19. Apparatus as set forth in claim 18 wherein said magnet means includes:

a generally elongated permanent bar magnet and having its poles at edges of said magnet.

20. Apparatus as set forth in claim 19 wherein said means for adjusting includes:

means for mounting said bar magnet beneath said slide with its longitudinal axis at an angle relative to said first normal direction.

21. Apparatus as set forth in claim 20 wherein said means for adjusting includes:

means for adjusting the distance between said bar magnet and said slide.

22. Apparatus as set forth in claim 15 which further includes:

means coupled to at least said slide for vibrating the material thereon to keep said granules separate and mobile.

23. An apparatus as set forth in claim 15 wherein said means for controlling temperature includes:

a container surrounding said slide which forms a reservoir of a coolant liquid for lowering the temperature of the material by evaporation.

24. Apparatus as set forth in claim 23 wherein said cooling means further includes:

a temperature control system for maintaining the temperature of said slide above the temperature of said coolant liquid.

25. Apparatus as set forth in claim 23 wherein said coolant liquid is liquid $N_2$.

26. Apparatus for separating a selected superconductive phase from a granular multiphase material wherein granules contain different volume percentages of said selected superconductive phase, said apparatus comprising:

a nonmagnetic inclined slide for applying a resultant gravitational force to material thereon causing said material to move by gravity in a first normal direction in a first normal path, whereby the amplitude of the resultant gravitational force is determined by the inclinaton of said slide;

magnet means for applying a magnetic field to the mixture such said granules including these containing said selected superconductive phase area penetrated thereby;

means for changing the temperature of the mixture of the slide to a temperature where at least said superconductive phase is superconducting such that at least a portion of any of said granules containing said selected superconductive phase on the slide is deflected from said first normal path to a second selected path by diamagnetic force; and means for collecting said deflected superconductive phase granules.

27. An apparatus as set forth in claim 26 which further includes:

means for adjusting the inclination of said slide.

28. An apparatus as set forth in claim 27 which further includes:

means for adjusting the magnitude of the deflection from said first normal path.

29. An apparatus as set forth in claim 26 wherein said magnet means for generating said magnetic force includes:

means for adjusting the intensity and direction of said magnetic force.

30. An apparatus as set forth in claim 29 wherein said magnet means fcr generating said magnetic force includes:

a generally elongated permanent bar magnet and having its poles at sharp edges.

31. An apparatus as set forth in claim 30 wherein said adjustment means further includes:

means for mounting said bar magnetic beneath said slide with its longitudinal axis at an angle relative to said first normal direction.

32. An apparatus as set forth in claim 31 wherein said adjustment means further includes:

means for adjusting the distance between said bar magnet and said slide.

33. An apparatus as set forth in claim 26 which further includes:

means coupled to at least said slide for vibrating the material thereon to keep said granules separate and mobile.

34. An apparatus as set forth in claim 26 wherein said means for controlling temperature includes:

a container surrounding said slide which forms a reservoir of a coolant liquid lowering the temperature of the material by evaporation.

35. An apparatus as set forth in claim 34 wherein said cooling means further includes:

a temperature slide at a different temperature than said coolant liquid.

36. An apparatus as set forth in claim 34 wherein said coolant liquid is liquid $N_2$.

37. Apparatus for separating a selected superconductive phase from a comminuted granular multiphase material containing a volume percentage of the selected superconductive phase granules and a volume percentage of other phase granules, said apparatus comprising:

means for maintaining the material at a temperature where at least the selected superconductive phase granules exhibit superconductivity;

means for applying an initial force which acts on the selected superconductive phase granules and other phase granules equally, said initial force capable of moving said material in a first normal direction;

means for forming a magnetic field which is substantially zero at a center location and increases in intensity and gradient radially outward therefrom, said field being elongated along a central axis passing through said center location, said axis being positioned such that it intersects said first normal direction but is not coincident therewith; and wherein said magnetic field forming means deflects at least said selected superconductive phase granules from said first normal direction along said axis to separate them from said other phase granules which continue to move in said first normal direction.

* * * * *

UNITED STATES PATENT AND TRADEMARK OFFICE

CERTIFICATE OF CORRECTION

PATENT NO. : 4,828,685

DATED : May 9, 1989

INVENTOR(S) : Richard B. Stephens

It is certified that error appears in the above-identified patent and that said Letters Patent is hereby corrected as shown below:

In the Drawings, Sheet 1, FIG. 8, the term "Δ(X)0" should read --Δ(X)--.

On the front of the patent, for patent No. 4,127,477 change "Schloeman" to --Schloemann--.

In column 1, line 20, change "0°K" to --0°K.--.

In column 1, line 29, change "becoxe" to --become--.

In column 1, line 49, after the word "wave" insert --)--.

In column 1, line 60, change "every day" to --everyday--.

In column 2, line 2, change "Tc" to --$T_c$--.

In column 2, line 13, change "Tc" to --$T_c$--.

UNITED STATES PATENT AND TRADEMARK OFFICE

CERTIFICATE OF CORRECTION

PATENT NO. : 4,828,685

DATED : May 9, 1989

INVENTOR(S) : Richard B. Stephens

It is certified that error appears in the above-identified patent and that said Letters Patent is hereby corrected as shown below:

In column 2, line 26, change "Tc" to --$T_c$--.

In column 2, line 32, change "voluue" to --volume--.

In column 3, line 5, change "Tc" to --$T_c$--.

In column 3, line 68, change "Tc" to --$T_c$--.

In column 4, line 34, change "embodix:ent" to --embodiment--.

In column 6, line 3, change "Fg" to --$F_g$--.

In column 6, line 4, change "Fm" to --$F_m$--.

In column 6, line 6, change "Fg" to --$F_g$--.

In column 6, line 8, change "augle" to --angle--.

In column 6, line 8, change ¼ to --$\theta$--.

In column 6, line 11, change "Fg" to --$F_g$--.

In column 6, line 12, change "Fm" to --$F_m$--.

In column 6, line 17, after "Δ, insert --(x)--.

In column 6, line 27, change "take" to --taken--.

In column 6, line 31, delete the comma ",".

In column 6, line 34, change "an-end" to --an end--.

UNITED STATES PATENT AND TRADEMARK OFFICE

CERTIFICATE OF CORRECTION

PATENT NO. : 4,828,685

DATED : May 9, 1989

INVENTOR(S) : Richard B. Stephens

It is certified that error appears in the above-identified patent and that said Letters Patent is hereby corrected as shown below:

In the Drawings, Sheet 1, FIG. 6, should be deleted and the following FIG. 6 substituted therefore:

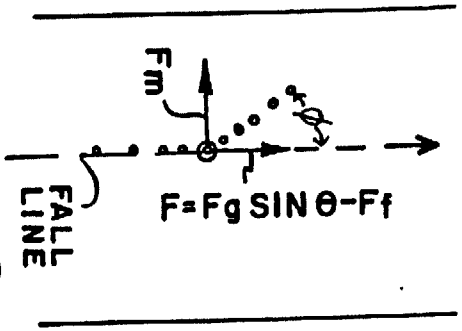

FIG. 6

UNITED STATES PATENT AND TRADEMARK OFFICE

CERTIFICATE OF CORRECTION

PATENT NO. : 4,828,685

DATED : May 9, 1989

INVENTOR(S) : Richard B. Stephens

It is certified that error appears in the above-identified patent and that said Letters Patent is hereby corrected as shown below:

In column 6, line 66, change "Tc" to --$T_c$--.

In column 6, line 68, after the word "to" insert --its--.

In column 7, line 1, change "Tc" to --$T_c$--.

In column 7, line 11, change "Hc" to --$H_c$--.

In column 7, line 12, change "Tc" to --$T_c$--.

In column 7, line 15, change "Hc" to --$H_c$--.

In column 7, line 18, change "Hc" to --$H_c$--.

In column 7, line 19, change "Hc" to --$H_c$--.

In column 7, line 24, change "Hc" to --$H_c$--.

In column 7, lines 27 and 28, the formula and its definitions should read as follows:

$H_c = H_o [1 - (T/T_c)^2]$ where $H_o$ = value of $H_c$ at absolute zero, and is proportional to $T_c$.

In column 7, line 30, change "Hc1" to --$H_{c1}$--.

In column 7, line 31, change "Hc2" to --$H_{c2}$--.

In column 7, line 31, change "Hc1" to --$H_{c1}$--.

UNITED STATES PATENT AND TRADEMARK OFFICE

CERTIFICATE OF CORRECTION

PATENT NO. : 4,828,685

DATED : May 9, 1989

INVENTOR(S) : Richard B. Stephens

It is certified that error appears in the above-identified patent and that said Letters Patent is hereby corrected as shown below:

In column 7, line 32, change "Hc2" to --$H_{c2}$--.

In column 7, line 33, change "Hc" to --$H_c$--.

In column 7, line 33, change "Hc1" to --$H_{c1}$--.

In column 7, line 35, change "Hc" to --$H_c$--.

In column 7, line 36, change "Hc1" to --$H_{c1}$--.

In column 7, line 50, change "Hc1 and Hc2" to --$H_{c1}$ and $H_{c2}$--.

In column 7, line 50, change "Hc2" to --$H_{c2}$--.

In column 7, line 54, change "Hc2" to --$H_{c2}$--.

In column 7, line 64, change "Hc" to --$H_c$--.

In column 7, line 67, change "Hc" to --$H_c$--.

In column 7, line 68, change "Hc1" to --$H_{c1}$--.

In column 8, line 10, the portion of the formula reading (T/Tc) should read ($T/T_c$).

In column 8, line 24, change "∂B/∂z" to --∂B/∂Z--.

In column 8, line 33, change "Fm" to --$F_m$--.

UNITED STATES PATENT AND TRADEMARK OFFICE

CERTIFICATE OF CORRECTION

PATENT NO. : 4,828,685

DATED : May 9, 1989

INVENTOR(S) : Richard B. Stephens

It is certified that error appears in the above-identified patent and that said Letters Patent is hereby corrected as shown below:

In column 8, line 37, the formula should appear as follows:

$$F_m = \frac{\pi r^2}{C} \frac{\partial B}{\partial Z} = \frac{\pi r^3}{2} \frac{\partial B}{\partial Z}$$

In column 8, line 40, change "$mg = \rho\pi^3 g$" to --$mg = \rho\pi r^3 g$--.

In column 8, line 48, the left hand portion of the formula should read:

$$\frac{\partial B}{\partial Z}$$

In column 8, line 50, change "Hc1" to --$H_{c1}$--.

In column 8, line 65, change "Hc1" to --$H_{c1}$--.

In column 8, line 67, change "Hc1 and Hc2" to --$H_{c1}$ and $H_{c2}$--.

In column 9, line 1, change "Fm" to --$F_m$--.

In column 9, line 3, change "Hc1" to --$H_{c1}$--.

UNITED STATES PATENT AND TRADEMARK OFFICE

CERTIFICATE OF CORRECTION

PATENT NO. : 4,828,685

DATED : May 9, 1989

INVENTOR(S) : Richard B. Stephens

It is certified that error appears in the above-identified patent and that said Letters Patent is hereby corrected as shown below:

In column 9, line 4, change "Tc" to --$T_c$--.

In column 9, line 6, change "Hc1" to --$H_{c1}$--.

In column 9, line 6, change "Hc2" to --$H_{c2}$--.

In column 9, line 12, change "Hc1" to --$H_{c1}$--.

In column 9, line 14, change "Hc" to --$H_c$--.

In column 9, line 14, change "Tc" to --$T_c$--.

In column 9, line 21, change "multiphasc" to --multiphase--.

In column 9, line 24, after "separation" insert a period --.--.

In column 9, line 44, change "Fm" to --$F_m$--.

In column 9, line 54, change "Fg" to --$F_g$--.

In column 9, line 64, change "Fg" to --$F_g$--.

In column 9, line 65, change "sin $\phi$" to --sin $\theta$--.

In column 9, line 65 change "$\phi$" to --$\theta$--.

In column 9, line 68, the formula should read:

$F_f = \mu F \cos \theta$--.

UNITED STATES PATENT AND TRADEMARK OFFICE

CERTIFICATE OF CORRECTION

PATENT NO. : 4,828,685

DATED : May 9, 1989

INVENTOR(S) : Richard B. Stephens

It is certified that error appears in the above-identified patent and that said Letters Patent is hereby corrected as shown below:

In column 10, line 1, change "Ff" to --$F_f$--.

In column 10, lines 40, 41 change "the magnetic field" to --$\Delta(X)$--.

In column 10, line 44, change "after" to --After--.

In column 10, line 56, change "Tc" to --$T_c$--.

In column 11, line 5, change "V2" to --$V_2$--.

In column 11, line 6, change "V1" to --$V_1$--.

In column 11, lines 15-16, the word "inccmplete" should read --incomplete--.

In column 11, line 28, change "Tc" to --$T_c$--.

In column 12, line 27, change "precent" to --percent--.

In column 13, line 2, after "and" insert --is--.

In column 13, line 22, change "Tc" to --$T_c$--.

In column 13, line 28, change "Tc" to --$T_c$--.

In column 13, line 49, change "Tc" to --$T_c$--.

In column 13, line 51, change "Tc" to --$T_c$--.

In column 13, line 52, change "Tc" to --$T_c$--.

UNITED STATES PATENT AND TRADEMARK OFFICE

CERTIFICATE OF CORRECTION

PATENT NO. : 4,828,685

DATED : May 9, 1989

INVENTOR(S) : Richard B. Stephens

It is certified that error appears in the above-identified patent and that said Letters Patent is hereby corrected as shown below:

In column 13, line 55, change "Fm" to --$F_m$--.

In column 13, line 56, change "Tc" to --$T_c$--.

In column 13, line 59, change "Tc" to --$T_c$--.

In column 13, line 60, change "Tc" to --$T_c$--.

In column 14, line 24, change "Hc1" to --$H_{c1}$--.

In column 14, line 29, change "Fm" to --$F_m$--.

In column 15, line 1, change ""pipe38" to --"pipe"--.

In column 15, line 37, change "Tc" to --$T_c$--.

In column 16, line 10, change "Tc" to --$T_c$--.

In column 16, line 18, change "Tc" to --$T_c$--.

In column 16, line 19, change "Tc" to --$T_c$--.

In column 16, line 40, change "effected" to --affected--.

In column 16, line 51, change "%" to --percent--.

In column 16, line 54, change "approximate" to --approximately--.

In column 16, line 60, change "%" to --percent--.

UNITED STATES PATENT AND TRADEMARK OFFICE

CERTIFICATE OF CORRECTION

PATENT NO. : 4,828,685

DATED : May 9, 1989

INVENTOR(S) : Richard B. Stephens

It is certified that error appears in the above-identified patent and that said Letters Patent is hereby corrected as shown below:

In column 17, line 54, change "diagramatically" to --diagrammatically--.

In column 18, line 44, (Claim 4, line 3), change "Hcl" to --$H_{cl}$--.

In column 18, line 47, (Claim 5, line 2), change "tha" to --the--.

In column 19, line 20, (Claim 9, line 4), change "phases" to --phase--.

In column 19, line 37, (Claim 11, line 3), change "Hcl" to --$H_{cl}$--.

In column 19, line 46, (Claim 13, line 2), change ":" to --;--.

In column 19, line 58, (Claim 15, line 1), change "selected" to --selected--.

In column 19, line 63, (Claim 15, line 6), change "inclinded" to --inclined--.

In column 19, line 67, (Claim 15, line 10), change "gavitational" to --gravitational--.

In column 20, line 62, (Claim 26, line 9), change "whereby" to --wherein--.

In column 20, line 66, (Claim 26, line 13), after "such" insert the word --that--.

UNITED STATES PATENT AND TRADEMARK OFFICE

CERTIFICATE OF CORRECTION

PATENT NO. : 4,828,685

DATED : May 9, 1989

INVENTOR(S) : Richard B. Stephens

It is certified that error appears in the above-identified patent and that said Letters Patent is hereby corrected as shown below:

In column 20, line 66, (Claim 26, line 13), change the word "these" to read the word --those--.

In column 20, line 67, (Claim 26, line 14), change "area" to --are--.

In column 21, line 25, (Claim 30, line 2), change "fcr" to --for--.

In column 22, line 11, (Claim 35, line 3) after the word "temperature" insert the phrase --control system for maintaining the temperature of said--.

Signed and Sealed this

Thirtieth Day of June, 1992

*Attest:*

*Attesting Officer*

DOUGLAS B. COMER

*Acting Commissioner of Patents and Trademarks*